United States Patent [19]

Thompson

[11] 4,246,435

[45] Jan. 20, 1981

[54] FILLED COMMUNICATION CABLE EMPLOYING A PARAFFINIC OIL-BASE FILLING COMPOUND

[75] Inventor: Paul F. Thompson, Millington, N.J.

[73] Assignee: General Cable Corporation, Greenwich, Conn.

[21] Appl. No.: 59,221

[22] Filed: Jul. 20, 1979

[51] Int. Cl.[3] ..... H01B 7/28; H01B 3/30

[52] U.S. Cl. ..... 174/23 C; 174/110 PM; 174/107; 174/116; 585/6.6

[58] Field of Search ..... 174/23 C, 23 R, 110 PM, 174/107, 116; 252/63, 64; 156/48

[56] References Cited

U.S. PATENT DOCUMENTS

| | | | |
|---|---|---|---|
| 3,697,670 | 10/1972 | Mitacek | 174/110 PM X |
| 3,888,710 | 6/1975 | Buek | 174/23 C X |
| 3,893,961 | 7/1975 | Walton et al. | 174/23 C |
| 4,109,099 | 8/1978 | Dembiak et al. | 174/107 |

FOREIGN PATENT DOCUMENTS

| | | | |
|---|---|---|---|
| 2657280 | 7/1978 | Fed. Rep. of Germany | 174/23 C |
| 1203138 | 8/1970 | United Kingdom | 174/23 C |

*Primary Examiner*—Arthur T. Grimley

*Attorney, Agent, or Firm*—Roy C. Hopgood; John M. Calimafde; Charles W. Neill

[57] ABSTRACT

Petrolatum-based filling compounds are known to migrate into the insulation and jacket of telephone cables and to extract the stabilizers, and as a consequence, to affect the physical and/or electrical characteristics of those cable components. It does not seem possible to avoid these characteristics of petrolatum in commercial compounding operations. The filling compound of this specification is for use in telephone cables and is based on better resistance to dripping at elevated temperatures, compatibility with high density polyethylene insulation and low density and medium density polyethylene jacket compounds. It has processability at moderate elevated temperatures, resistance to cracking at room temperature and low temperatures, adhesiveness and desirable electric properties.

10 Claims, 2 Drawing Figures

FILLED COMMUNICATION CABLE EMPLOYING A PARAFFINIC OIL-BASE FILLING COMPOUND

BACKGROUND AND SUMMARY OF THE INVENTION

The petrolatum used in the preparation of a filling compound is already a semisolid at room temperature and as such requires only a relatively slight modification to be converted into a material for filling air spaces in the telephone cables as conventionally manufactured. This invention provides an improved filling compound that is more compatible with the conventional plastic insulation of the conductors in filled telephone cables than a petrolatum-based filling compound.

The filling compound of this specification uses a paraffinic type oil blended with amorphous polypropylene, wax and polyethylene with an antioxidant. The characteristics of these added ingredients will be explained in the detailed description.

Other objects, features and advantages of the invention will appear or be pointed our at the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
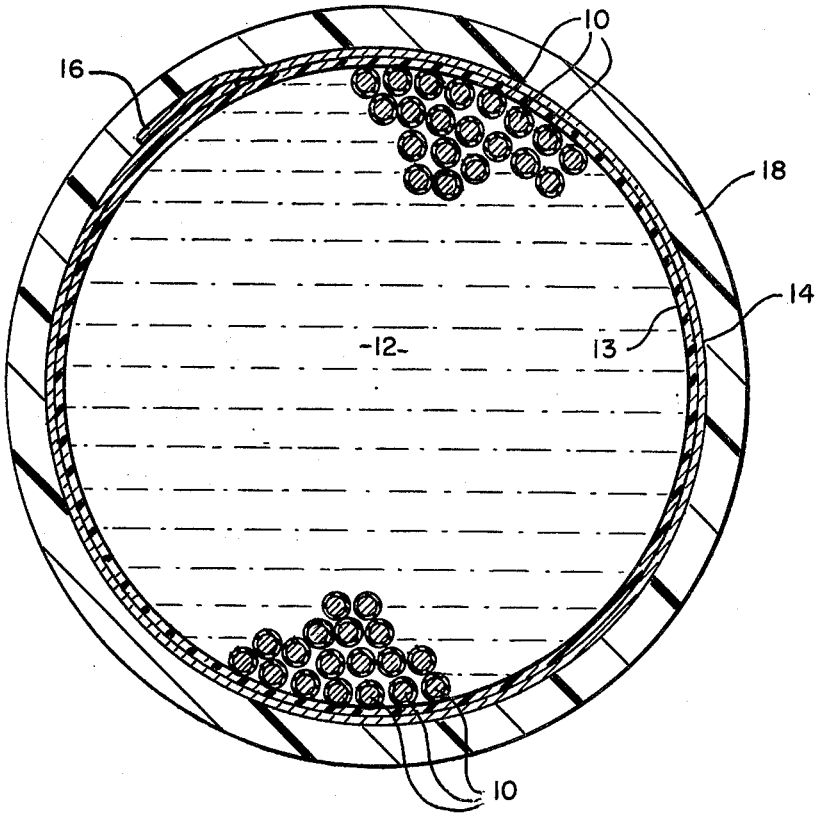
FIG. 1 is a sectional view through a communication cable made in accordance with this invention.
Figure 2:
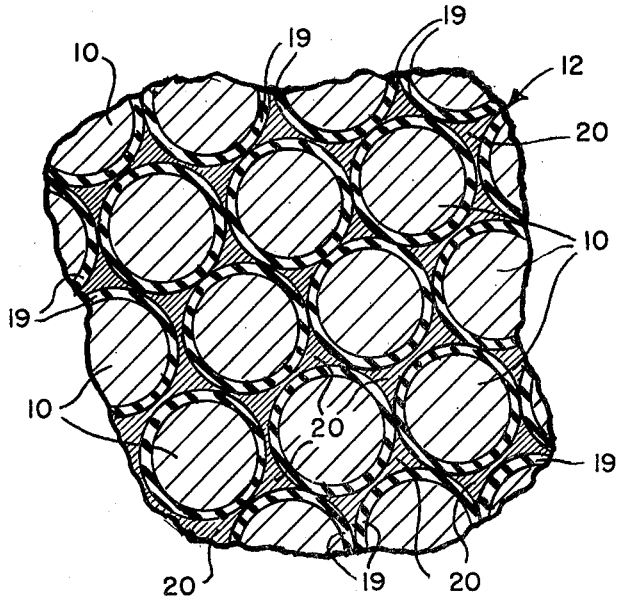
FIG. 2 is a greatly enlarged, fragmentary view of the cable shown in FIG. 1, the larger scale showing more clearly the space within the core of the cable and around the filling compound of this invention.

The drawing shows individual insulated conductors 10 assembled in a generally circular cross-section which forms the core 12 of the cable. These insulated conductors 10 may be bound together in a conventional way by a binder 13 of plastic tape, and the core is surrounded by a metal shield 14, preferably aluminum, shown as a tape folded longitudinally around the core with a longitudinally extending lap seam 16. This shield 14 is preferably aluminum foil; which may be copolymer protected as in U.S. Pat. Nos. 3,206,541 and 3,629,489 and it is covered by a protecting jacket 18 made of polyethylene, polyvinyl chloride or other suitable jacketing material. Insulation 19 on the conductors 10 is preferably polyethylene.

Since the conductors 10 are of round cross-section, there is space between the conductors where they are not tangent to one another; and this space contains the filler 20 of the present invention. It will be understood that the core 12 is filled with the conductors 10 and that the filler 20 permeates all spaces within the core which is not occupied by the insulated conductors 10.

The filler material 20 must be flexible and should be tacky so as to adhere to the insulation jackets around the conductors and to itself. It must also remain flexible at the lowest temperature to which the cable will be subject when put to its intended use.

The drip point must be high enough so that the filler 20 will not leak out of the core at any location where there may be a break in the shield 14 or a leak at the seam 16 or clearance at terminations or splices where liquid within the cable could run out.

The filler of this invention retains its flexibility so as to pass the standardized bend test at temperatures of about −36 to −40 degrees C. The tacky characteristics of the filler are retained at these bend temperature tests. The drip point of the filler is from about 85 degrees C. to about 110°, depending upon the compounding.

In the examples which follow, the ingredients will be identified by the symbols used in the test procedures, and further identification of the ingredients will follow the description of the results obtained by various formulations.

Example A used 100 parts of paraffinic oil (2280); 50 parts of amorphous polypropylene (M-5K); 5 parts of Rosswax (RW-140) and 5 parts of Fisher Tropsch wax. This filler had a drip point of 95° to 100° C. and satisfactory low temperature bend test at −40° C.

Example B: In this example, the amount of wax used was cut in half by omitting the Rosswax and substituting for it 10 parts of low molecular weight polyethylene. This change raised the drip point to 100°-105° C. and the low temperature bend remained at −40° C.

Example C: In this example, the compounding was the same as in Example B, except that the number of parts of polyethylene were reduced from 10 to 8 and an antioxidant Irganox 1010 was added in an amount of 0.2 parts. The drip point was reduced 5° C., and the low temperature bend test was −36° C. instead of −40°.

Example D used a different paraffinic oil Sunflex 3340 of 100 parts, and amorphous polypropylene (M-5K) of 40 parts. The total amount of wax used was the same as in Example A but in slightly different proportions, 4 parts wax Rosswax 140 and 6 parts of Fisher Tropsch wax. No polyethylene was used, but 0.2 parts of antioxidant Irganox 1010 was used in the formulation. The drip point was 80° to 85° C.; the low temperature bend test was −40° C.

Example E used the same amount of oil and amorphous polypropylene as in Example D, but no wax was used and no polyethylene. The antioxidant Irganox 1010 was retained. The drip point was the same as in Example D, but the low temperature bend test was −36° C. instead of −40°.

Example F substituted a different oil Sunpar 2280 for the Sunflex 3340 of Example E, but retained the same amount (100 parts), and retained the same amount of amorphous polypropylene and antioxidant. The drip point remained the same at 85° C; but the low temperature bend was reduced from −36° to −40° C.

Example G used the same oil as in Example F but reduced the amount of amorphous polypropylene from 40 to 30 parts; and included wax in the mixture. 8 parts of wax Rosswax 140 were used with 2 parts of Fisher Tropsch. The same amount of antioxidant was used as in Example F. This change raised the drip point from 85° to 100° C., and the low temperature bend remained at −40° C.

Example H used the same ingredients as Example G but a different amorphous polypropylene was used (M-5W). The drip point was raised 5° C., and the low temperature bend was −40° C.

Example I used the same formulation as Example H except that the 10 parts of wax were made up of only one kind of wax, Rosswax 140, and this change raised the drip point to a temperature in excess of 110° C. with the low temperature bend still at −40° C.

Other tests were made using the same formulation as Example I but using 5 parts of low molecular weight polyethylene and different waxes: Fischer Tropsch, Melkon and XFQ Cardipol LP; but while the viscosity and tacky characteristics remained satisfactory, no higher drip point could be obtained than with Examples H and I.

The paraffinic oil Sunpar 2280 has a SUS viscosity of about 2500 at 100° F. and a pour point of about −15° C. The paraffinic oil Sunflex 3340 has an SUS voscosity of about 3500 at 100° F. and a pour point of about −15° C. Both Sunpar 2280 and Sunflex 3340 may be obtained from the Sun Oil Co. located at Tulsa, Oklahoma. The amorphous polypropylenes M-5K and M-5W were procured from Eastman Chemical Products located at Kingsport, Tennessee.

Rosswax 140 is a synthetic wax made by Frank B Ross Co., Inc. of Jersey City, New Jersey. Melkon a microcrystalline wax, Fischer Tropsch, a synthetic wax and XFQ Cardipol LP a polyolefin wax, were obtained from Western Petro Chemical of Chanute, Kansas. The low molecular weight polyethylene NA-250 was obtained from U.S. Industrial Chemical of Pittsburgh, Pa. The antioxidant Irganox 1010 can be obtained from Ciba-Geigy of Ardsley, New Jersey.

Preferred embodiments of the invention have been described, but changes and modifications can be made and the equivalent materials substituted without departing from the invention as defined in the claims.

What is claimed is:

1. A filled communication cable for telephone communication and the like including a plurality of insulated conductors secured together in a core of the cable, a plastic tape binder, a metal shield, and a plastic jacket surrounding the metal shield, an improved filling compound in the core in contact with the insulation on said conductors, the improved filling compound comprising a paraffinic type oil mixed with amorphous polypropylene, characterized by the oil comprising 100 parts and the amorphous polypropylene comprising from approximately 30 to 50 parts of the filling compound, and further characterized by the compound also containing up to about 10 parts of low molecular weight polyethylene.

2. A filled communication cable for telephone communication and the like including a plurality of insulated conductors secured together in a core of the cable, a plastic tape binder, a metal shield, and a plastic jacket surrounding the metal shield, an improved filling compound in the core in contact with the insulation on said conductors, the improved filling compound comprising a paraffinic type oil mixed with amorphous polypropylene characterized by the paraffinic oil having a Saybolt universal viscosity of about 2500 to 3500 seconds at 100° F.

3. The filled communication cable described in claim 1 characterized by the oil in the filling compound comprising a blend of paraffinic type oils having a Saybolt universal viscosity of about 2500 to 3500 seconds at 100° F.

4. The filled communication cable described in claim 1 characterized by the amorphous polypropylene having a ring and ball softening point of about 100° C. to 110° C.

5. A filled communication cable for telephone communication and the like including a plurality of insulated conductors secured together in a core of the cable, a plastic tape binder, a metal shield, and a plastic jacket surrounding the metal shield, an improved filling compound in the core in contact with the insulation on said conductors, the improved filling compound comprising a paraffinic type oil mixed with amorphous polypropylene characterized by the oil comprising 100 parts and the amorphous polypropylene comprising from approximately 30 to 50 parts of the filling compound, and further characterized by the filling compound containing up to about 10 parts of wax having a melting point between 70° C. and 150° C., the amount of wax used depending on the melting point of the wax with higher melting point increasing the drip point of the filling compound.

6. The filled communication cable described in claim 1 characterized by the filling compound having up to about 10 parts of polyethylene resin having a melt index of about 225 to 275 grams at 10 minutes.

7. The filled communication cable described in claim 1 characterized by including about 0.2 to 0.6 parts of an antioxidant that protects the polyethylene insulation on the conductors when in contact with the filling compound.

8. The filled communication cable described in claim 1 characterized by the oil comprising 100 parts and the amorphous polypropylene comprising approximately 30 to 50 parts of the filling compound, the paraffinic type oil having a Saybolt universal viscosity of about 2500 to 3500 seconds at 100° F., the amorphous polypropylene having a ring and bell softening point of about 100° C. to 100° C., and the filling compound containing up to about 10 parts of wax having a melting point between 70° C. and 150° C., and further characterized by the filling compound having up to about 10 parts of a low molecular weight polyethylene resin having a melt index of about 225 to 275 grams at 10 minutes and about 0.2 to 0.6 parts of an antioxidant that protects the polyethylene insulation.

9. The filled communication cable described in claim 1 characterized by the filler having a drip point as high as 85° C. and a low temperature bend as low as −36° C.

10. The filled communication cable described in claim 9 characterized by the drip point being at least as high as 100° C.

* * * * *